US005490479A

United States Patent [19]

Shalev

[11] Patent Number: 5,490,479

[45] Date of Patent: Feb. 13, 1996

[54] METHOD AND A PRODUCT RESULTING FROM THE USE OF THE METHOD FOR ELEVATING FEED STORAGE BINS

[76] Inventor: Matti Shalev, P.O. Box 843, Statesville, N.C. 28677

[21] Appl. No.: 58,208

[22] Filed: May 10, 1993

[51] Int. Cl.[6] ..... E04H 7/22; A01K 5/00

[52] U.S. Cl. ..... 119/51.01; 52/194

[58] Field of Search ..... 119/51.01, 52.1, 119/57.91; 52/194; 414/919

[56] References Cited

U.S. PATENT DOCUMENTS

| | | | |
|---|---|---|---|
| 2,583,203 | 1/1952 | Bergeron | 119/52.1 |
| 2,606,676 | 8/1952 | Dempster | 414/919 X |
| 3,651,787 | 3/1972 | Cooper | 119/51.01 |
| 3,753,506 | 8/1973 | Palmer et al. | 52/194 X |

*Primary Examiner*—Robert P. Swiatek

[57] ABSTRACT

A method for and a product resulting from the use of the method for elevating livestock feed storage bins having multiple supporting legs that avoids the need to lift the entire storage bin by crane or other elevating devices, the method including the steps of affixing a lifter engaging member to one of the multiple supporting legs, positioning a lifter proximate the leg and contiguous with the lifter engaging member, and actuating the lifter to elevate the leg to a preselected height sufficient to install data processing monitoring equipment thereunder to elevate the supported bin to a location greater than the height of the installed equipment. The balance of the multiple supporting legs are fitted and engaged sequentially in the same manner to enable the installation of other cooperative components of the data processing equipment whereby the feed storage bin, upon the total installation, resides at a higher elevation consistent with the height of the data processing equipment.

2 Claims, 1 Drawing Sheet

METHOD AND A PRODUCT RESULTING FROM THE USE OF THE METHOD FOR ELEVATING FEED STORAGE BINS

BACKGROUND OF THE INVENTION

1. Field of the Invention

The present invention relates to a method and a product produced by utilizing that method for elevating feed storage bins to receive data processing or other equipment without lifting the entire feed bin in a single operation.

2. Description of the Prior Art

Feed storage bins have been used for livestock for many years in order to provide an inventory of food dispensable over a sustained period of time in regular quantities to maintain the particular herd involved in good health and physical condition through a growing season so as to ultimately bring the livestock to a marketable condition. Feed bins have been provided with regulating devices to dispense feed in an even and consistent manner, however, it has been only rather recently that more sophisticated devices have been employed to monitor herd daily feeding practices, accumulate the quantity of feed fed to a flock over a period of time, govern the precise time of day for feedings to take place, and monitor total inventory of feed so that orders can be placed for additional supplies of feed in a cost efficient manner.

Data processing or computer controlled devices for accumulating feed information and regulating feed flow have now been developed and are finding their way into various farms where flocks of livestock are being raised over discrete periods of time. These devices can take many forms, such as monitoring feed levels in storage bins or monitoring the weight of the feed within the bin when first filled and thereafter in increments to determine feed flow and inventory needs. One of the most effective developments in this area involves data processing equipment that is weight sensitive and has means for controlling feed flow over a wide range of conditions. These devices are required to be positioned under the feed storage bins in order to weigh the contents of the bins. The most basic of these devices involves installing four components at, for example, four legs of a feed storage bin which has been elevated to the extent necessary to receive these components thereunder. This installation procedure has normally been undertaken by the use of cranes that move into the field proximate the storage bins and lift the entire storage bin from the ground to the extent necessary for the time needed in order to position the data processing equipment under each of the multiple legs of the bin. While this is a very effective process for carrying out the installation of these devices, it is expensive and time consuming to bring a large mobile crane to a storage bin site and to make the various connections necessary to lift the bin totally from the ground and position the needed components under its multiple legs. The crane then lowers the bin so that the legs engage the components and the entire assembly is once again connected to the ground engaging supporting pad.

Obviously the need for reducing the cost involved in modifying existing feed storage bins to accommodate these data processing components has increased and the present invention is directed to solving that longfelt need.

OBJECTIVES AND SUMMARY OF THE INVENTION

Accordingly, it is an object of the present invention to provide a novel and improved process for installing data processing and other equipment in connection with feed storage bins which has all of the advantages of the prior art and none of the disadvantages.

Another object of the present invention is to provide a new and improved method for elevating feed storage bins that avoids the need for a mobile crane to lift the entire storage bin in one operation to make the necessary and needed installation.

Another object of the present invention is to provide a new and improved method for elevating a feed storage bin to the extent necessary to install complimentary equipment that enables the entire installation process to be completed by a single individual.

Yet still a further object of the present invention is to provide a storage bin elevated to new and greater height than the height to which it was initially erected resulting from employing the steps of the method set forth herein.

These and other objects of the present invention which will become apparent as the description proceeds are accomplished by lifting the multiple supporting legs of an elevated feed storage bin sequentially as a lifter engages a first supporting leg, positions the needed component thereunder, lowers the leg, and engages a second supporting leg to initiate the same process. Each leg is sequentially treated in a similar manner, and the final result is an elevated feed storage bin positioned at a height greater than the initial installation height so as to accommodate data processing or other components beneath each of its multiple legs.

Thus, there has been outlined, rather broadly, the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of the construction and to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting. Those skilled in the art will appreciate the concept upon which this disclosure is based and may readily be utilized as a basis for designing other structures, methods and systems carrying out the several purposes of the present invention. It is important that the claims be regarded as including such equivalent constructions in so far as they do not depart from the spirit and scope of the present invention.

BRIEF DESCRIPTION OF THE DRAWINGS

The description will be more easily understood from the following detailed description of the preferred embodiment taken in conjunction with the accompanying drawings wherein like characters of reference designate like parts throughout the several views, and wherein.

DETAILED DESCRIPTION OF THE SPECIFICATION

Figure 1:
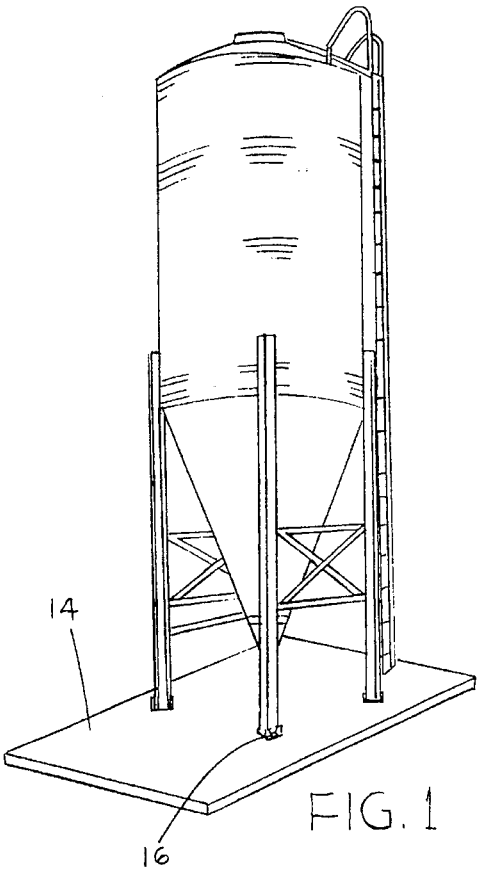
FIG. 1 is a perspective view of a feed storage bin as initially installed and without having been subjected to the method of the present invention.

Referring now to the drawings and particularly to FIG. 1, livestock feed storage bins such as the one shown generally as 10 are utilized consistently around the world to feed flocks of livestock that are nourished and maintained on farms for various food and breeding markets. These bins 10 are normally installed on a concrete pad 14 and are secured to that pad by feet 16 that engage bolts usually embedded in the pad when it is poured. Securing the bin to the pad with these bolts insures that it will not be dislodged or toppled in the event of windstorms or other adverse conditions or occurrences.

A need has now developed for monitoring, regulating, dispensing and predicting the consumption of feed for livestock through various computerized devices or data processing components. The most practical of these appear to be devices used to sense the weight of the feed carried by the bin at any particular time so that various pieces of information can be processed from that monitoring activity. To enable the data processing components to be in a position to monitor accurately the weight of feed contained by bins at any particular time, it is necessary to install appropriate instrumentation underneath the bins. The most direct approach for this installation process is to remove the bolts that anchor the legs of bin 10 to concrete pad 14 and, by the use of a crane or other mobile lifting device, lift the entire bin from the pad for a period of time within which the appropriate sensing components can be installed thereunder. These components are positioned proximate the bolt locations initially anchoring the bin and in a manner so that they can once again be reconnected to the multiple legs of the bin when it is lowered for reconnection to the pad.

To avoid the expense of bringing in a mobile crane or other lifting device to the bin site and utilizing a number a people to operate and lift the bin for the purpose described, it has now been found to be a more practical solution after removing the anchor bolts holding the legs to the concrete pad, to elevate the multiple legs of the feed bin, a single leg at a time (sequentially), so that only one person is needed to introduce the needed instrumentation and expense is significantly reduced because a mobile crane or other lifting device is no longer essential.

Figure 4:
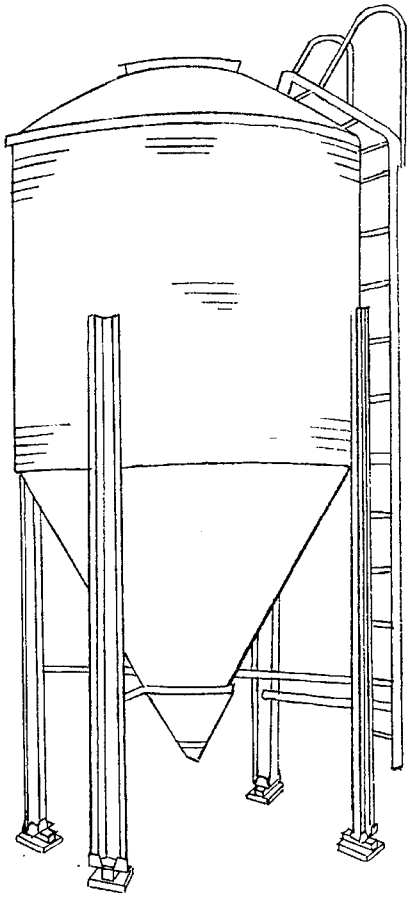
FIG. 4 is a perspective view of a feed storage bin having been supplied by the method embodying the present invention with the data processing components needed to monitor feed inventory and feeding practices.
Figure 3:
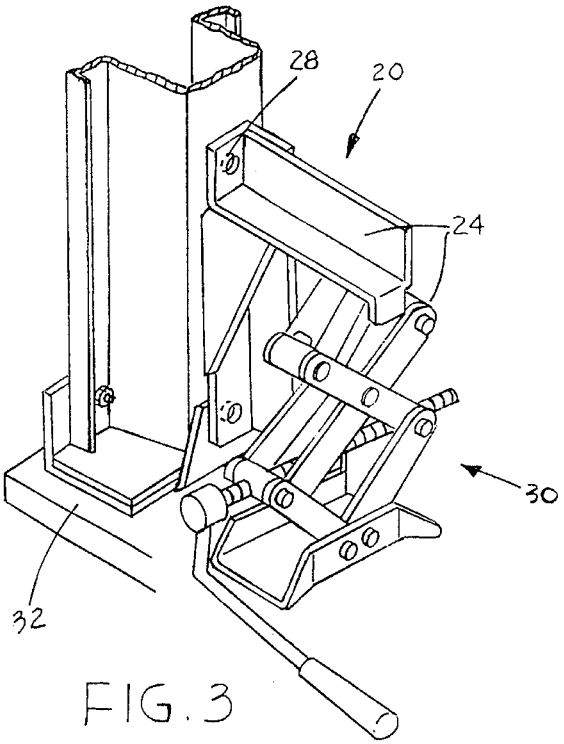
FIG. 3 is a perspective, fragmentary, and enlarged view of the lifter engaging member affixed to a leg of the feed storage bin involved in the method comprising the present invention.
Figure 2:
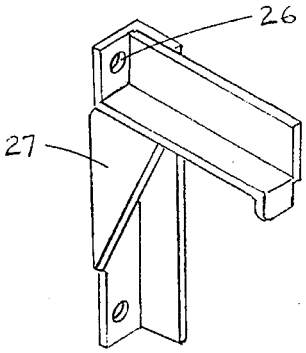
FIG. 2 is a perspective, sectional and enlarged view of the vertical portion of the lifter engaging member utilized to practice the method of the present invention.

The most practical approach to utilizing this new method is to utilize a lifter engaging member, shown generally as 20, having a vertical portion 22 and a step 24, the vertical portion having apertures 26 that align with apertures 28 drilled in each of the legs of the storage bin, as best shown in FIGS. 3 and 4. Vertical portion 22 is then bolted to a single leg and a conventional jack, shown generally as 30, can be positioned underneath step 24 and on a suitable support 32 to enable it to be actuated. Operation of the jack lifts the lifter engaging member and affixed leg the distance needed to position the appropriate piece of equipment beneath the leg. Once that instrument has been so positioned, the leg is repositioned and secured, and the step 20 is disengaged and reattached to the next of the multiple legs. The process is repeated, the leg is raised by the jack, and the instrument is placed thereunder. The leg is resecured with the instrument therebeneath, the step member is disconnected and reconnected to a new leg member and the process continues. This process goes forward until all leg members have been raised, suitable data processing components are positioned thereunder, and the leg members have been resecured to the supporting surface.

Obviously the lifter engaging member 20 can be formed in any convenient configuration so long as it is structured to sustain the force exerted by the lifter to lift the leg for the distance needed. It is to be realized that the optimum dimensional relationships for the parts of the invention, to include variations in size, materials, shape, form, function, and manner of operation, assembly and use are deemed readily apparent and obvious to one skilled in the art and all equivalent relationships to those illustrated in the drawings and described in the application are intended to be encompassed herein. The foregoing is considered as illustrative only of the principles of the invention.

Since numerous modifications and changes will readily occur to those skilled in the art, it is desired not to limit the invention to the exact construction and operation shown and described. All suitable modifications and equivalents that fall within the scope of the appended claims are deemed within the present inventive concept.

I claim:

1. A method of elevating feed storage bins having multiple supporting legs without lifting the entire feed storage bin comprising the steps of: affixing a lifter engaging member to one of the multiple supporting legs; positioning a lifter proximate the one of the legs and the affixed engaging member; engaging and lifting the leg to a predetermined height sufficient to install monitoring equipment in a fixed relationship with the leg to elevate the supported bin at the leg location to a higher elevation commensurate with the height of the monitoring equipment; and sequentially lifting each of the other legs and installing monitoring equipment to elevate the supported storage bin so that the storage bin has been elevated a distance consistent with the height of the monitoring equipment when the monitoring equipment is in place.

2. The method as claimed in claim 1 wherein the lifter engaging member includes a horizontal step member and a vertical storage leg engaging member attached to the step member.

* * * * *